US007883161B2

(12) United States Patent
Wischnowsky et al.

(10) Patent No.: US 7,883,161 B2
(45) Date of Patent: Feb. 8, 2011

(54) ROLL TOWEL DISPENSER

(75) Inventors: Peter Wischnowsky, Napier (NZ); Kathleen B. Gorres, Remsen, NY (US)

(73) Assignee: Darman Manufacturing Company Inc, Utica, NY (US)

( * ) Notice: Subject to any disclaimer, the term of this patent is extended or adjusted under 35 U.S.C. 154(b) by 632 days.

(21) Appl. No.: 11/811,243

(22) Filed: Jun. 8, 2007

(65) Prior Publication Data

US 2008/0302901 A1 Dec. 11, 2008

(51) Int. Cl.
*B65H 19/00* (2006.01)

(52) U.S. Cl. ..... 312/34.1; 242/538.1

(58) Field of Classification Search ..... 242/538.1, 242/538.2, 538.3, 538; 312/34.11, 34.12, 312/34.8, 34.9, 34.1, 34.24
See application file for complete search history.

(56) References Cited

U.S. PATENT DOCUMENTS 1,353,416 A * 9/1920 Orcutt ..... 312/34.11
1,765,504 A * 6/1930 Steiner et al. ..... 312/34.11
2,140,440 A * 12/1938 Chidsey, Jr. ..... 312/34.11

* cited by examiner

*Primary Examiner*—William A Rivera
(74) *Attorney, Agent, or Firm*—Robert O. Wright

(57) ABSTRACT

A greatly simplified roll towel dispenser having far fewer parts than conventional dispensers is shown. The dispenser also has a minimal carbon footprint using recycled materials throughout and a sealed battery for primary power. With the simple dispensing mechanism battery life of months is possible as are remote and portable applications.

13 Claims, 4 Drawing Sheets

ROLL TOWEL DISPENSER

This invention relates to roll towel dispensers and more particularly to environmentally sensitive means for providing recycled toweling for wiping/drying uses having a minimum carbon foot print. With the increasing attention being paid to global warming and the attendant environmental factors believed to be causing the warming it has become increasingly important to reduce to the minimum the creation of pollution and consumption of natural resources. Recycling has thus become important in all aspects of modern life. The toweling/wiping industry is one such activity and the present invention is an attempt to improve significantly the long term environmental impact thereof.

BACKGROUND

Continuous roll towel dispensers have been available for many years. Generally they have involved a loop of cloth towel material fed out of a first slot of a cabinet and taken up through another slot. Various manually operated and power operated devices have been developed and there are literally hundreds of patents covering this art. Recently the towel material has included various paper and synthetic products as well as the traditional cotton and linen products. Machines dispensing individual sheets of paper and sheet portions tom from rolls of paper are also well known in the industry. All of these machines have become increasingly sophisticated and complicated in part to address their impact on the environment, and while the effect of paper in its various forms versus cloth has been and continues to be debated in the industry, the need for an environmentally friendly low carbon footprint wiping/drying solution has become preeminent.

OBJECTS AND SUMMARY OF THE INVENTION

Accordingly it is a primary object of the present invention to provide a greatly simplified roll towel dispenser that can be made largely of recycled material and will permit easy reuse of the toweling/wiping material.

It is another object of the present invention to provide a roll towel dispenser device in which the clean toweling is easy to install and the used toweling is easy to remove and reprocess for additional use.

It is another object of the present invention to provide a roll towel dispenser in which the toweling is contained totally within the dispenser cabinet with no exposure to the user except when actually required for a drying/wiping operation.

It is a still further object of the present invention to provide a roll towel dispenser in which the used toweling material is completely retracted into the dispenser cabinet after use so that it can not be accessed from the outside by vandals or other unauthorized users.

It is yet another object of the present invention to provide a simplified take up reel spindle that may be easily installed in the dispenser and easily removed from a roll of used toweling.

It is a still further object of the present invention to provide a dispenser in which gravity feeds the clean toweling out of the cabinet after unrolling from the supply.

It is another object of the present invention to provide a roll towel dispenser that can dispense a variety of web materials without machine modifications.

These and other and further objects of the invention are achieved in an embodiment in which an enclosure has a pair of spaced apart vertical end plates therein joined by an horizontal shelf forming an upper compartment for a roll of clean toweling; a horizontal feed roll is rotatably mounted between said end plates along the front edge of said plate; a used material take-up spindle is rotatably mounted between said plates below said shelf; a pivotably mounted wall plate is hung below said shelf on the bottom front edge of the shelf extending to adjacent the rear edge of an opening in the bottom of the enclosure; individual gear motors are mounted on said end plates to power said feed roller and take-up spindle; computer control means are used to operate the motors and a battery is used to power the apparatus.

DESCRIPTION OF A PREFERRED EMBODIMENT

Figure 1:
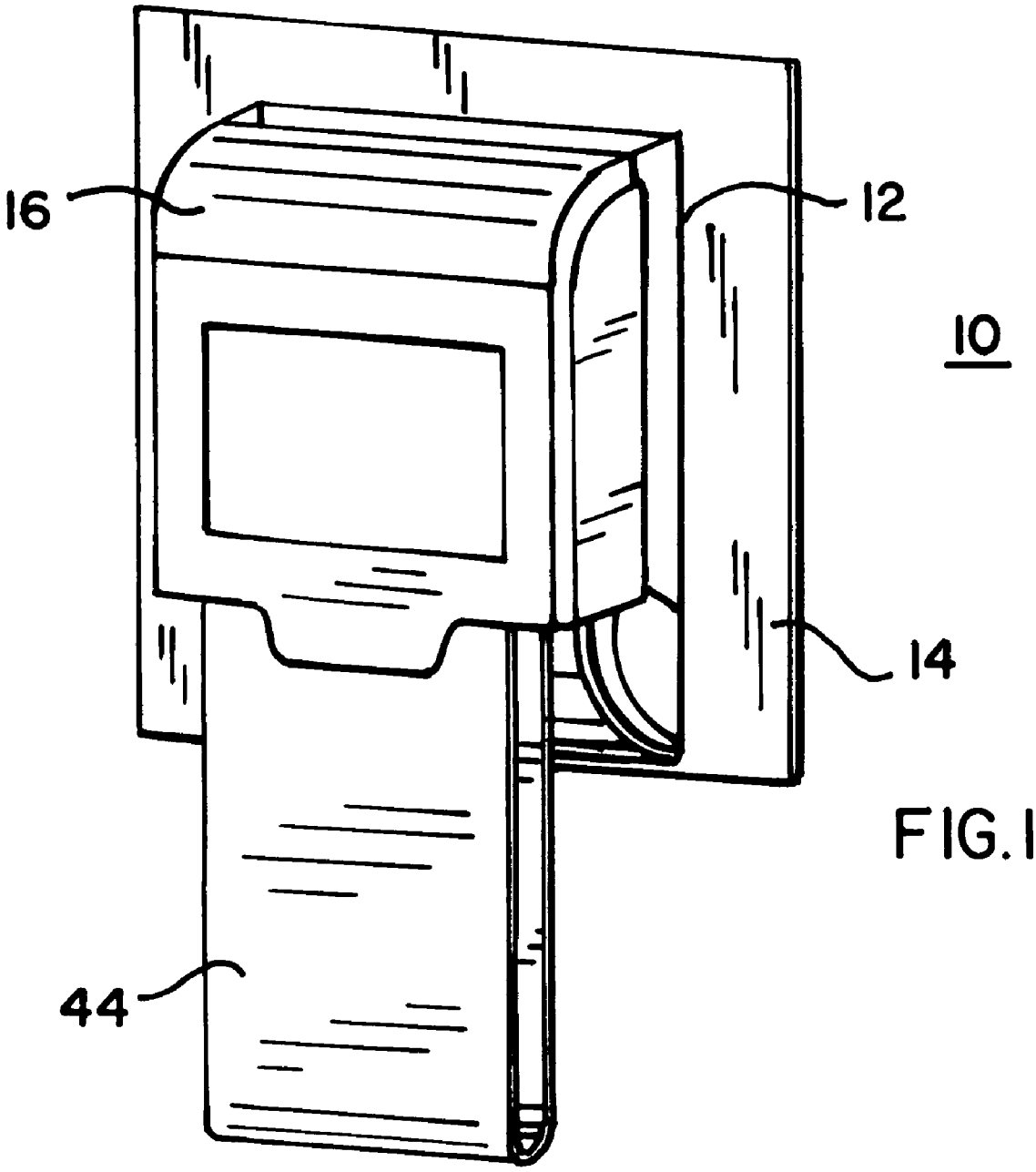
FIG. 1 is a front perspective view of the dispenser of the present invention mounted on a wall with the toweling shown in the actuated ready to use position.
Figure 2:
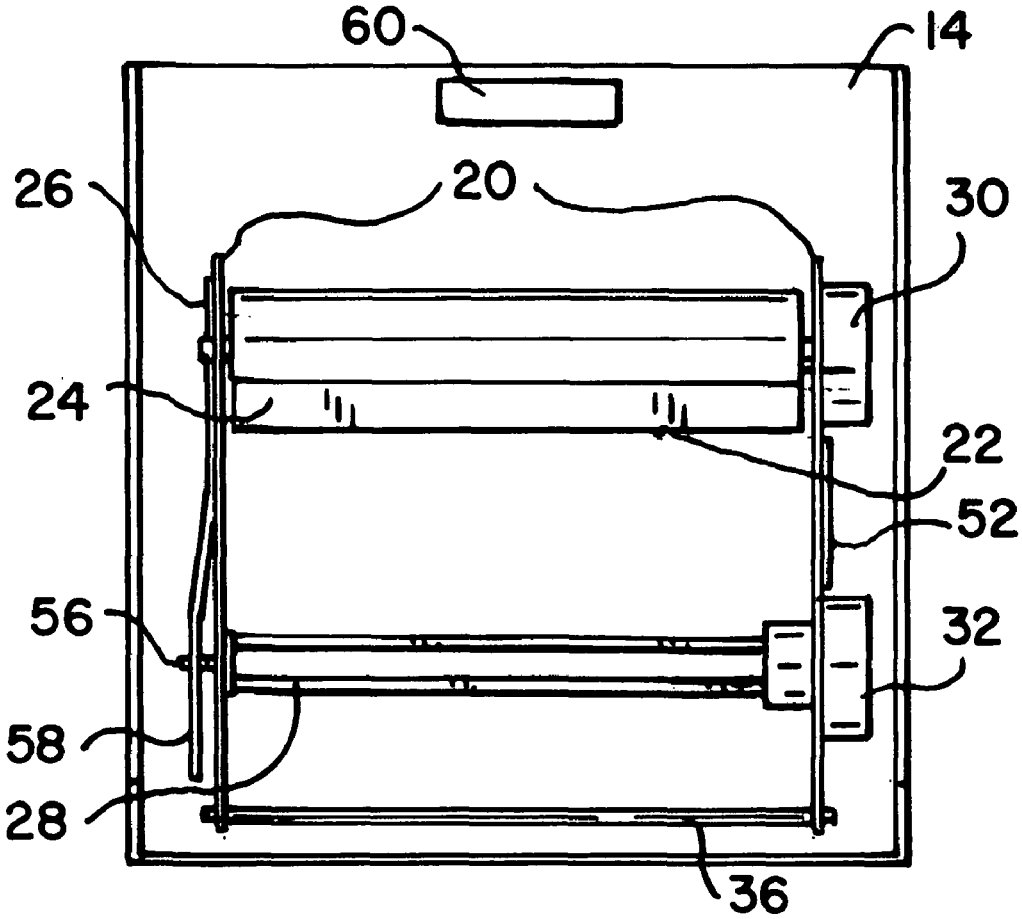
FIG. 2 is a front elevation of the apparatus with the front housing and door removed.

Referring now to FIG. 1 the towel dispenser 10 is shown with its base 12 mounted on a wall portion 14 with the front housing 16 which is pivotally mounted at the top of base 14 in the closed position. A loop 44 of toweling is shown in the actuated ready to use position. Inside the housing 16 the very simple structure includes a pair of spaced apart end plates 20 (see FIG. 2) mounted on the base 14.

Figure 4:
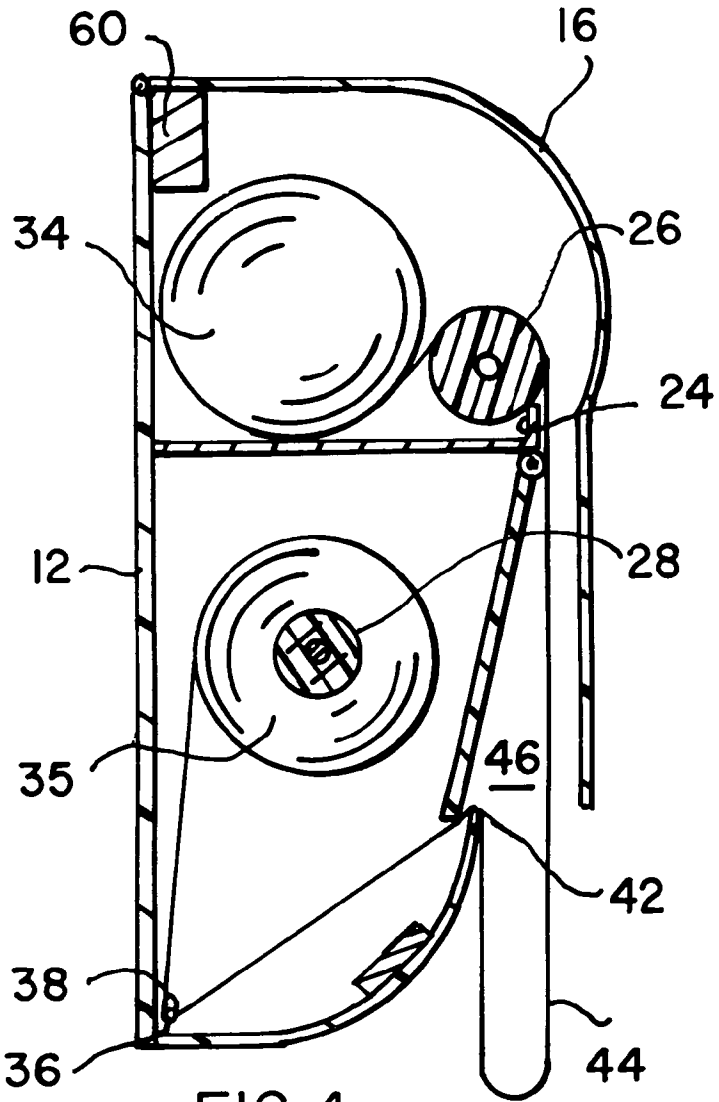
FIG. 4 is a view similar to FIG. 3 but with the towel in the actuated ready to use position.
Figure 3:
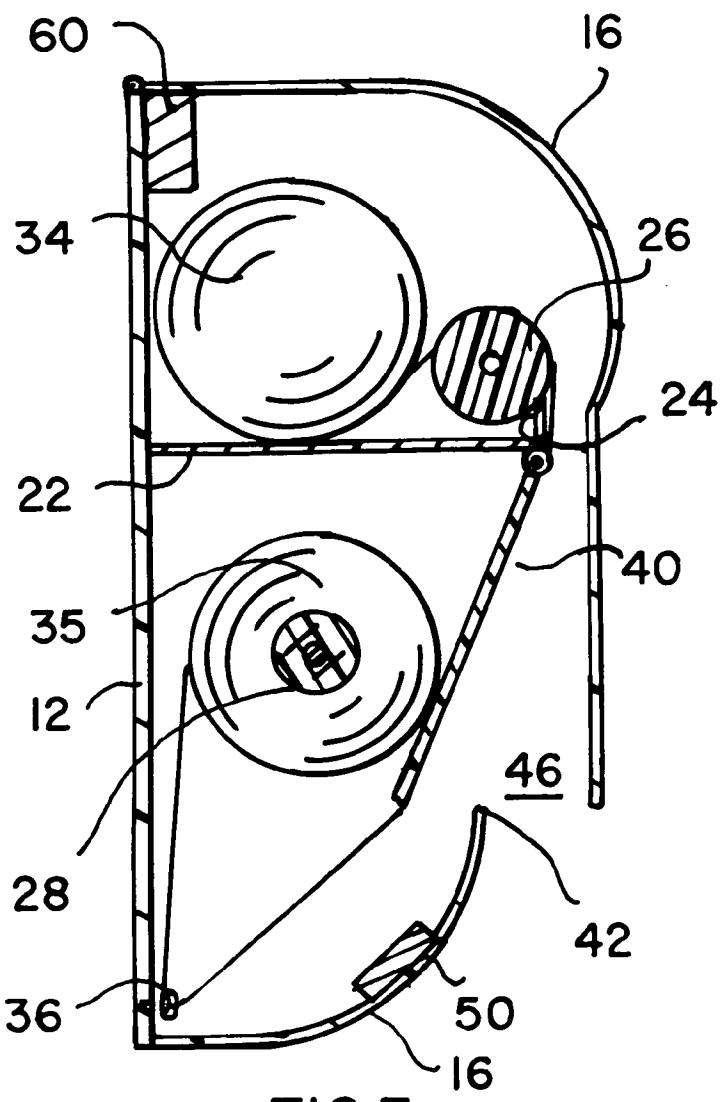
FIG. 3 is a sectional view taken on the center line of FIG. 1 looking to the right with the towel in the fully retracted position.

Mounted between the plates 20 is a shelf 22 which at it front edge has a lip portion 24 (see also FIGS. 3 & 4). Journaled in end plates 20 just above shelf 22 is feed roller 26. The surface of roller 26 is preferably formed from a rubber like material to provide good frictional contact with toweling when a roll of toweling 34 is placed on the shelf 22. Also journaled between plates 20 is the take-up spindle 28. Gear motors 30 and 32 are mounted on the outer surface of the right hand plate 20 and drive the roller 26 and spindle 28 respectively. These motors are typically low voltage DC motors and are powered by battery 60 mounted on the upper portion of base member 12. Motion sensor 50 is mounted on the inside of the lower portion of front housing 16 and initiates the feed and retract cycles The simplicity of the mechanism can be more fully appreciated by referring to FIGS. 3 & 4. A roll 34 of toweling material is placed in the upper compartment formed by the shelf 22. The free end of toweling is then withdrawn from the bottom of roll 34, over roll 26 and fed down into the lower compartment and threaded through the spindle 28 after first passing about shaft 36 in the FIGS. 3 & 4 embodiment. Shaft 36 is journaled in a hole in the left hand plate 20 and a small vertical slot 38 in the right hand plate 20. This serves as a tension control limit as will be explained in detail herein. A pivotally mounted door 40 is hung from the under side of shelf 22 and extends to just past the lip 42 of an opening 46 in the front housing 16.

Roller 26 powered by motor 30 feeds toweling from the bottom of roll 34 out off the shelf 22 and by gravity causes it to fall down the inside of front housing 16 and out the slot 46 to form the loop 44. Tension in the toweling is released while the toweling is being fed out by roll 26 to form the loop 44 and, door 40, tends by gravity to move from the "fully rewound position" of FIG. 3 to contacting lip 42 to close the lower compartment (See FIG. 4) and help direct the fresh toweling down the inside of the front housing and out the slot 46 where it can be grasped by a user. Loop 44 may be easily used to dry hands or wipe other objects as desired. Spindle 28 is fixed during this fresh toweling feed cycle.

After the toweling loop 44 has been used and the sensor 50 no longer senses any motion, a signal is sent to motor 32 to rotate spindle 28 to wind up and retract all the previously exposed toweling loop. This retract cycle is completed when the tension in the toweling causes shaft 36 to be raised and trip a sensor mounted on the right hand end plate to shut off motor 32 resulting in the condition shown in FIG. 3. In addition to the tension sensor actuated by shaft 36 to shut off further retracting of the loop 44 a sensor and program in the computer board 52 senses excessive pulling on the toweling material such as might be encountered if an arm or hand were caught in loop 44 and causes motor 30 to immediately feed toweling material into loop 44 relieving the tension and allowing the safe removal of any obstruction. The amount of fresh toweling fed out to relieve the obstruction is generally limited to one or two cycles. This feature will also limit damage from deliberate attempts to damage the dispenser since the gear motors 30 and 32 can not be forced into reverse rotation by excessive pulling on the toweling material. As may be seen in FIG. 3 when the dispenser is in the "fully rewound" state it is virtually impossible to gain access to the interior of the housing or even exert enough tension on the toweling to trigger this safety feature. Alternatively torque or other tension sensors than the foregoing may be used to stop retraction and provide the safety features.

Figure 6:
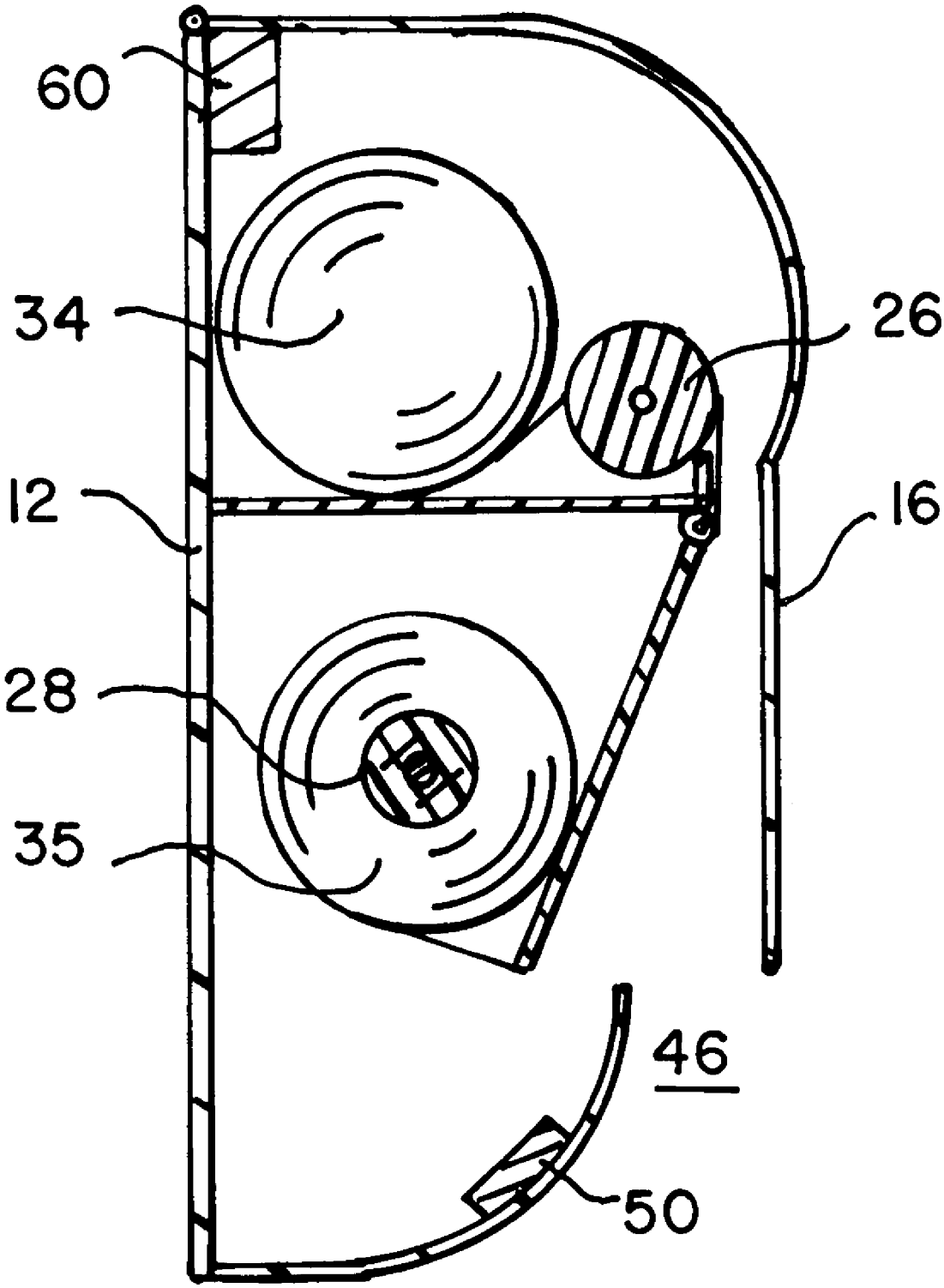
FIG. 6 is a view similar to FIG. 4 with another tension sensor.

FIG. 6 shows an alternative way to sense toweling tension to shut off the rewind motor 32. In this embodiment the computer senses the motor current and when it senses the increased "stall" current condition it turns off power to motor 32 resulting in the condition shown in FIG. 6. Door 40 will function in the same manner to close the take-up compartment as in FIGS. 3 & 4.

Figure 5:
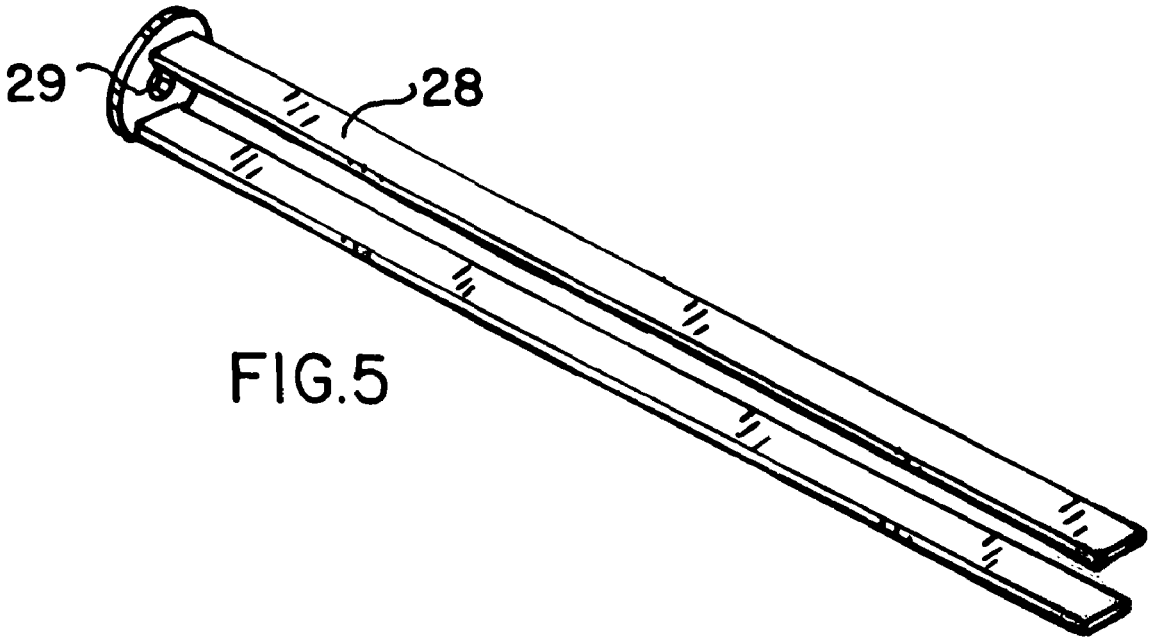
FIG. 5 is a perspective view of the take-up spindle.

Referring now to FIG. 5 the spindle 28 is formed by a flat sided elongated U shaped two tine fork with the open end adapted to fit into a bushing fixed on the shaft of motor 32. The closed end of fork 28 has a hole 29 adapted to engage a stub shaft 56 formed on spring arm 58 secured to the outside of the left hand end plate 20 (see FIG. 2). This also allows the easy removal of the completely retracted roll 35 of toweling from the machine by simply flexing arm 58 to the left in FIG. 2 to withdraw the stub shaft from the hole 29 in the closed end of the U shaped spindle 28. Spindle 28 may also be collapsed and easily pulled out of the wound up used toweling.

The computer board 52 is mounted on the right side end plate and is programmed to perform at least the following steps namely: power up; check for cover open; check for towel fully rewound; check for movement pulses; turn on towel feed; check for movement pulses; turn off towel feed; turn on towel rewind; check for towel fully rewound; disable movement and turn on "call attendant" upon preselected conditions occurring. Other operations may be added as required.

While there are given above certain specific examples of the invention and its application in practical use, it should be understood that they are not intended to be exhaustive or to be limiting of the invention. On the contrary, these illustrations and explanations herein are given in order to acquaint others skilled in the art with this invention and the principles thereof and a suitable manner of its application in practical use.

We claim:

1. A device for dispensing predetermined length segments of a continuous web of material for a processing operation comprising in combination:

a base member adapted for mounting on a surface, said base member having a top and a bottom;

an outer housing having top portion, a bottom portion, side portions, and a front portion adapted to be connected to said base member to form an enclosure;

a shelf member positioned on said base member to form an upper compartment to receive a supply of continuous web material within said outer housing;

a lower compartment having a bottom portion, side portions and a front portion extending upwardly from the bottom portion of said lower compartment, said lower compartment positioned at the bottom of said base member to receive segments of web material therein;

said upwardly extending lower compartment front portion forming with said outer housing front portion an unobstructed open slot adjacent the bottom of said outer housing front portion and an unobstructed web material vertical passageway extending downwardly from said shelf member to said unobstructed open slot;

web material take up means mounted in said lower compartment for retracting web material into said compartment;

web material feeding means positioned adjacent the front edge of said shelf member to feed web material from a continuous supply thereof, when placed in said compartment, over said front edge to cause said web material to cascade freely down through said unobstructed vertical passageway and out of said outer housing through said unobstructed open slot forming a depending loop of unprocessed web material when the distal end of said web material is connected to said web material take up means;

said web material take up means being positioned in said lower compartment to retract said depending loop of web material back up through said unobstructed open slot and completely into said lower compartment until all web material is fully withdrawn into said outer housing and away from said unobstructed open slot upon retracting operation thereof;

feeding and take up motor means operatively connected to said web material feeding means and said web material take up means;

sensing means for indicating when a requirement for feeding of web material out of said housing is required and when retracting of said web material into said housing is required;

control means for operating said motor means in accordance with the indication of said sensing means; and power means for supplying operating power to said motor, sensing, and control means mounted within said housing;

wherein a segment of said continuous web material may be dispensed from within said outer housing through said unobstructed open slot for use and thereafter completely retracted through said unobstructed open slot into said device entirely removing all web material from the exterior of said housing.

2. The invention as claimed in claim 1 further including a roll of toweling material positioned in said upper compartment and the distal end of said roll of toweling connected to said web material take up means.

3. The invention as claimed in claim 1 wherein said upper and lower compartments are formed by a pair of spaced apart vertical end plates mounted on said base member;

a horizontal shelf mounted between said end plates at the approximate midpoint thereof;

said web material feeding means comprises a roller mounted across the forward edge of said shelf member; and said web material take up means comprises an elongated flat sided U shaped spindle member rotatably mounted in said lower compartment.

4. The invention as claimed in claim 3 wherein said motor means comprise individual DC gear motors mounted on the side of said compartments with one driving said feeding roller and one driving said take up spindle member; and said power means comprises a battery mounted inside said enclosure.

5. The invention as claimed in claim 4 wherein said DC gear motors can not be reversed by pulling on said web material; and said control means stops said feeding roller motor means before said take up motor means to tightly tension said web material between said feeding means and said take up means to securely remove all said web material from the exterior of said device.

6. The invention as claimed in claim 1 wherein said motor means comprise low voltage DC gear motors; and said power means comprises an AC to low voltage DC converter.

7. The invention as claimed in claim 1 wherein said sensing means includes web material tension sensing means;

said control means includes means responsive to said tension sensing means to stop rewinding of said web material when said tension exceeds a predetermined amount and to automatically feed additional web material;

whereby injury to users of said dispensing device is prevented.

8. The invention as claimed in claim 1 wherein said sensing means comprises at least one motion detecting sensor mounted in said enclosure adjacent the front bottom of said front housing.

9. The invention as claimed in claim 1 wherein said web material take-up means comprises an elongated, flat sided, U shaped spindle removably pivotally mounted within said lower compartment; and a gear motor operatively connected to said spindle for rotation thereof.

10. The invention as claimed in claim 1 wherein said control means includes computer and software for performing at least the following steps:

power up; check for cover open; check for towel fully rewound; check for movement pulses; turn on towel feed; check for movement pulses; turn off towel feed; turn on towel rewind; check for towel fully rewound; disable movement and turn on call attendant upon preselected conditions.

11. A device for dispensing incremental lengths of a continuous web of material comprising in combination:

a dispenser structure having a base member adapted for mounting on a surface and a shelf member fixed to said base member and extending outwardly therefrom to form an upper material compartment;

a lower material compartment having a bottom portion, side portions, and a front portion extending upwardly from the bottom portion formed adjacent the bottom of said base member to receive processed lengths of continuous web material;

an outer housing member having a top portion, a front portion, a bottom portion and side portions operatively connected to the top of said dispenser base member and extending downwardly to at least a top of said front portion of the lower material compartment so as to form a narrow slot between the bottom of said outer housing and the front portion of the lower material compartment and an unobstructed open bottomed vertical narrow passageway between said outer housing member and said upper and lower material compartments;

a quantity of continuous web material positioned in said upper compartment;

a take up spindle rotatably mounted in said lower material compartment selectively operatively attached to the distal end of said web material to retrieve said web material from outside said outer housing;

power means for dispensing selected portions of said continuous web material into said unobstructed open bottomed vertical narrow passageway formed between said outer housing member and said dispenser structure so as to fall by gravity downwardly therethrough and out said unobstructed open slot to form a depending loop of said web material outside said outer housing member when the distal end of said continuous web material is operatively connected with said take up spindle;

power means for rotating said take up spindle to wind up said web material when operatively attached to the distal end of said web material; and control circuit means for selectively actuating said power material dispensing means and take up spindle power means to provide a depending loop of web material for performing a wiping/drying operation outside of said outer housing and then entirely retracting said processed loop of continuous web material through said unobstructed open slot into said lower compartment within said outer housing to completely remove all toweling from the exterior of said dispensing device and away from said unobstructed open slot.

12. The invention as claimed in claim 11 wherein said power means for dispensing portions of said continuous web material comprises a roller member extending across the outer edge of said shelf, having a frictionally enhanced surface, adapted to feed said web material off said shelf.

13. The invention as claimed in claim 11 wherein said take up spindle comprises a flat sided elongated U shaped two tine fork having an open end and a closed end with a shaft connected at said closed end; and said power means for rotating said spindle includes a bushing having two openings adapted to receive therein the ends of said two tines;

wherein said web material may be connected to said take up spindle by dropping the distal end thereof through said U shaped fork and winding said web material about said spindle and when a full roll of processed continuous web material is wound up thereon it may be removed from said dispenser and the processed web material easily slipped off the open end of said fork.

* * * * *